United States Patent [19]

Thompson

[11] 3,999,476

[45] Dec. 28, 1976

[54] CLOSED CHAMBER BALER

[75] Inventor: Wallace M. Thompson, Cordele, Ga.

[73] Assignee: American Hoist & Derrick Company, St. Paul, Minn.

[22] Filed: Mar. 28, 1975

[21] Appl. No.: 562,947

Related U.S. Application Data

[63] Continuation-in-part of Ser. No. 470,572, May 16, 1972, Pat. No. 3,929,062.

[52] U.S. Cl. ..... 100/7; 100/3; 100/26; 100/45; 100/49; 100/218; 100/249; 198/621; 198/737

[51] Int. Cl.[2] ..... B65B 13/20

[58] Field of Search ..... 100/7, 45, 49, 218, 100/26, 6, 98 R, 249, 4, 31, 3, 188 R; 198/221, 223

[56] References Cited

UNITED STATES PATENTS

| | | | |
|---|---|---|---|
| 1,985,438 | 12/1934 | Bethel | 100/3 |
| 2,768,574 | 10/1956 | Seltzer | 100/4 |
| 2,920,553 | 1/1960 | Van Marie | 100/26 X |
| 3,294,013 | 12/1966 | Seltzer | 100/218 |
| 3,521,550 | 7/1970 | Van Doorn | 100/26 |
| 3,528,364 | 9/1970 | Freund | 100/3 |
| 3,583,164 | 6/1971 | Sherrill | 100/188 R |
| 3,587,448 | 6/1971 | Hemphill | 100/3 |
| 3,590,731 | 7/1971 | Nichols | 100/7 |
| 3,613,556 | 10/1971 | Wright | 100/3 |
| 3,643,590 | 2/1972 | Aluotto | 100/3 |
| 3,673,950 | 7/1972 | Koehler | 100/218 |
| 3,720,158 | 3/1973 | Sauer | 100/26 |
| 3,733,769 | 5/1973 | Van Doorn | 100/26 |
| 3,827,349 | 8/1974 | Gilman | 100/3 |

*Primary Examiner*—Billy J. Wilhite
*Attorney, Agent, or Firm*—Cushman, Darby & Cushman

[57] ABSTRACT

An improved closed chamber baler includes a hopper into which is fed waste paper or other compressible materials to be baled. The material to be baled is forced into a bale chamber by means of a piston operated ram. Means are provided for sequentially guiding a strapping wire about the outside periphery of the compressed material at a plurality of vertically spaced intervals along the compressed material. The strapping wire is tensioned and then twisted or knotted together to form a continuous strap about the compressed material, thereby forming a bale. When the bale has been completely strapped, the compression ram is retracted and an output gate is opened. The bale is then ejected from the bale chamber by an automatic bale ejector. While the invention is disclosed in connection with baling waste paper, the closed chamber baler is capable of other uses, e.g., the baling apparatus embodying the principles of the present invention may be found useful in connection with the strapping of a wide variety of other articles to which multiple strapping loops are applied thereabout sequentially at vertically spaced intervals.

5 Claims, 13 Drawing Figures

CLOSED CHAMBER BALER

This application is a continuation-in-part of copending U.S. application Ser. No. 470,572, filed May 16, 1974, now U.S. Pat. No. 3,929,062.

BACKGROUND OF THE INVENTION

This invention broadly relates to a closed chamber baler for baling compressible materials and more specifically is related to a closed chamber baler for baling compressible materials such as waste paper wherein multiple strapping loops are sequentially applied at vertically spaced intervals about the bale while the bale is under relatively high compression and wherein the bales once formed are ejected from the baler.

Increased quantities of waste materials, such as paper and other shredded materials, can most easily be disposed of by bunching or baling the material so that a relatively large volume of the material is compressed into a relatively small volume for transportation and handling purposes. Typically these waste materials are shredded into fragments which are small in comparison with the overall dimensions of the bale. The bales produced are on the order of several feet square in a transverse direction and between five and six feet long in a longitudinal direction with the bales generally having a rectangular shape. In the past baling machines have been provided which include a hopper, a baling chamber and a ram which is actuated to compress material in the chamber. Accessory equipment, such as strapping, banding and tying devices, have been utilized to form the bale, examples of such strapping devices being disclosed in U.S. Pat. Nos. 2,768,574, 2,827,926, 2,763,297 and 2,853,885.

These prior art baling devices have had a number of drawbacks including the fact that they are of exceedingly complex structure and are not capable of rapidly applying a sequence of bands about the compacted waste material to form a bale. An example of a prior art baling device is illustrated in U.S. Pat. No. 3,528,364 which discloses an apparatus wherein waste material is compressed in a chamber and straps are positioned about the external periphery thereof in sequential order. This patent, however, does not disclose a method or apparatus for sequentially guiding wire about the outside periphery of a bale, binding the wire and then ejecting the bale from the baler. Other baling apparatus have been designed such as disclosed in U.S. Pat. Nos. 3,720,158 and 3,521,550 wherein bales of cotton are formed by utilizing a sequential bale strapping apparatus. The sequential bale strapping apparatus disclosed in these patents, however, are quite complex and therefore are subject to mechanical failure. In addition, these patents do not disclose a baling apparatus which automatically receives the material to be compressed, forms bales from the compressed material and then automatically ejects the formed bales in a continuous and efficient operation.

It therefore is an object of this invention to provide a closed chamber baler for efficiently and economically forming compressible material into bales.

SHORT STATEMENT OF THE INVENTION

Accordingly, this invention relates to a closed chamber baler which includes a hopper into which is fed a compressible material which is to be baled. A piston operated ram forces the material into a bale chamber wherein the material is formed into a bale. When the pressure exerted by the ram against the compressed bale of material reaches a predetermined level, the ram is held in its end of stroke position, and a means is provided for sequentially guiding a plurality of strapping loops about the outside periphery of the compressed material at a plurality of vertically spaced intervals. The strapping wire is tensioned and then tied together to form a continuous strap which extends about the outside periphery of the bale. After the bale has been strapped, the compression ram is retracted to thereby release the pressure on the bale. The gate is raised and the bale is forced a predetermined distance into an ejector mechanism by operation of the ram forcing more material into the bale chamber. The ejector mechanism is then activated to grip and pull the bale from the bale chamber. After the bale has been ejected from the bale chamber, the gate is closed and a new bale is formed.

BRIEF DESCRIPTION OF THE DRAWINGS

Other objects, features and advantages of the invention will become more fully apparent from the following detailed description of the preferred embodiment, the appended claims and the accompanying drawings in which:

DETAILED DESCRIPTION OF THE PREFERRED EMBODIMENT

Figure 1:
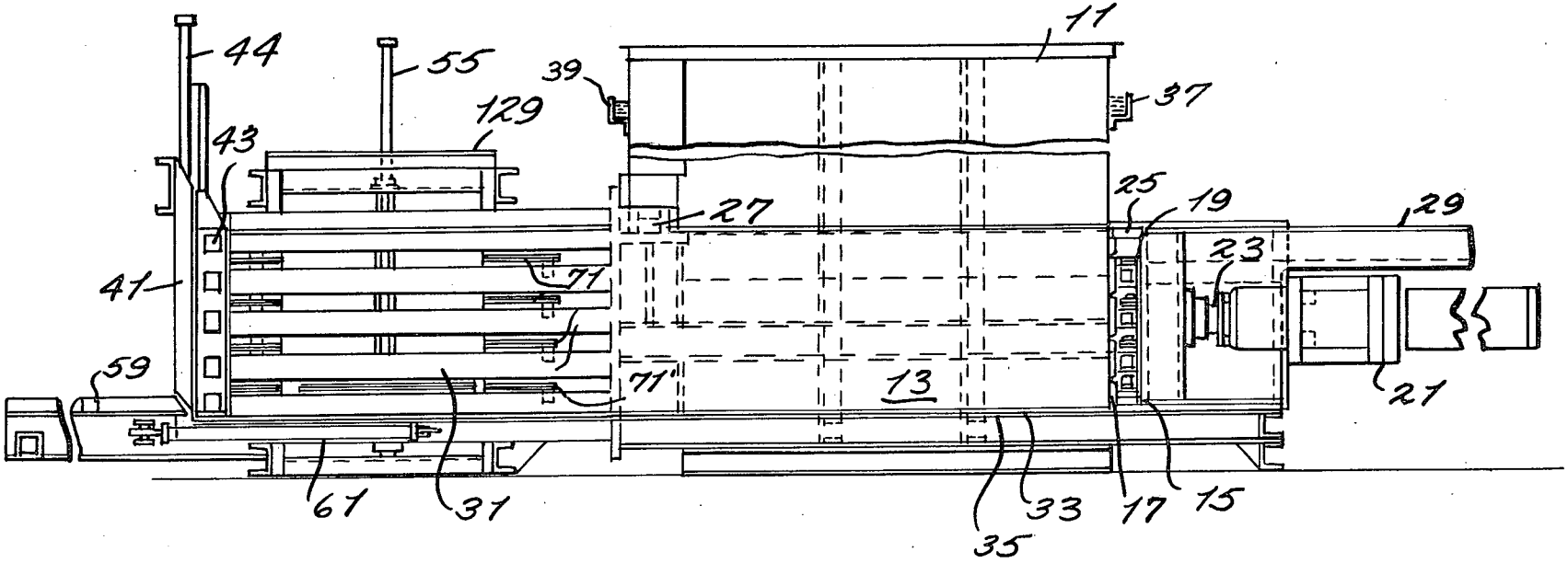
FIG. 1 is a longitudinal center section view taken in elevation of the closed chamber baler of the present invention.

Refer now to FIG. 1 where there is disclosed a longitudinal center section view taken in elevation of the closed chamber baler of the present invention. A hopper 11 is disclosed into which the material to be baled is dumped. The material may include waste paper or other shredded materials which are compressible or may include an agricultural product such as cotton. However, in the preferred embodiment, the operation of the invention will be discussed in connection with the compression and baling of waste paper. The hopper which, as illustrated, is in the form of a box but which may preferably be in the form of a funnel, leads into a waste material receiving chamber 13. Positioned to one side of chamber 13 is a compression ram 15 having a compression face 17 and a wire track assembly generally designated by the numeral 19. The compression ram 15 is reciprocated within chamber 13 by means of a piston and cylinder arrangement including a cylinder 21 and a piston rod 23. The piston and cylinder arrangement is capable of providing at least a nine foot stroke and for generating an operating pressure of at least 2400 psi. At the top of the compression ram is secured a shearing knife 25 which cooperates with a shearing beam knife 27 which is secured to the compression chamber at the junction of the hopper and the chamber 13. The shearing beam knife 27 is arranged so that its leading edge is formed diagonally with respect to the knife 25 so that the shearing force is sequentially distributed along the knife as the ram 15 passes the shearing beam knife 27. In addition, a horizontal shield plate 29 is provided, which extends across the width of the chamber and is at least as long as the length of the chamber 13 so that when the compression ram 15 is forcing waste paper into the baling chamber 31, waste paper being dumped into the hopper will not fall behind the ram 15.

At the bottom of the compression chamber 13 is an abrasive resistant wear plate 33 which is formed of known abrasive resistant materials. This plate is secured to the base plate 35 of the compression chamber 13. Positioned on the end walls of the hopper 11 is a photodetector system including a light source 37 and a photodetector of conventional design 39 which provide a ram actuating signal when the waste paper in the hopper intercepts the light beam passing from the light source 37 to the detector 39.

The baling chamber 31 includes an output or gate 41 which has a plurality of strapper guides 43 (shown schematically) extending transversely therethrough. The gate 41 is opened by means of a hydraulic cylinder 44 which raises the gate vertically after a bale has been formed in the baling chamber 31. The opposite end of the chamber 31 is normally open, but when material is being compressed therein, the ram compression face 17 forms the second end of the baling chamber 31. The two sides of the baling chamber 31 each includes a plurality of strapper wire tracks 71 for guiding the strapper wire about the outside periphery of the material compressed within the chamber. The wire tracks 71 terminate in mating guide tracks in the gate 41 and in the ram 15 each of which, as aforementioned, having parallel wire tracks extending from one side of the chamber to the other.

Also, as will be more fully explained hereinbelow, the process of strapping the wire about the compressed material takes place in sequential steps. Thus, when an appropriate quantity of compressible material has been compressed within the strapping or baling chamber 31, a first strapping wire is guided about the periphery of the compressed material through lowest level wire tracks including the elevator wire tracks 52 and 53, the lower curved wire tracks 71', the lower ram track 19, the straight wire track 51' and the lower gate wire track 43'. After the wire has been tensioned about the material and tied, a strapper elevator 129 which includes the strapper elevator cylinder 55, raises the strapping mechanism (not shown) to the next level, thereby stripping the wire strap from elevator tension pins 106. The wire is again passed around the outside periphery of the compressed material through the wire tracks which include curved tracks 71'', ram wire track 19'', elevator wire tracks 52 and 53, straight wire track 51'' and gate wire track 43'' until the wire has completely surrounded the compressed material. The wire is then tensioned and tied, and then the strapper is moved to the next succeeding level and so on. After all of the wires have been strapped about the compressed material and appropriately tied, the strapper elevator raises a predetermined distance, preferably on the order of an inch, to strip the top wire strap from elevator tension pins 106. The ram retracts to reduce bale friction force on gate, the gate raises with respect to the baling chamber 31 and straps are released from outboard tension pins.

More waste paper is then dropped from hopper 11 into chamber 13 and the compression ram 15 again forces the paper into baling chamber 31. The addition of waste paper to the chamber 31 forces the previously formed bale out through gate 41. After the formed bale has been pushed a predetermined distance out through the gate 41, such as for example, two feet, a limit switch 59 is actuated which energizes the bale ejector system. Thus, hydraulic fluid under pressure is coupled to the bale ejector cylinder 61 which, as will be explained, causes the ejector to grasp the bale and eject it from the baling chamber 31. When the ejection process has been completed, the gate 41 is returned to its closed position and the compression ram 15 continues to force waste paper into the baling chamber 31 until the pressure of the hydraulic fluid in the rear of the cylinder 21 is at least 1800 psi at the end of the compression stroke. When this occurs, the ram 15 remains fixed at its end of stroke position so that the compression face 17 forms an end wall of the baling chamber 31. The strapping process is again repeated and at the conclusion thereof, the gate 41 is raised and the ram 15 retracted to begin another cycle.

Figure 2:
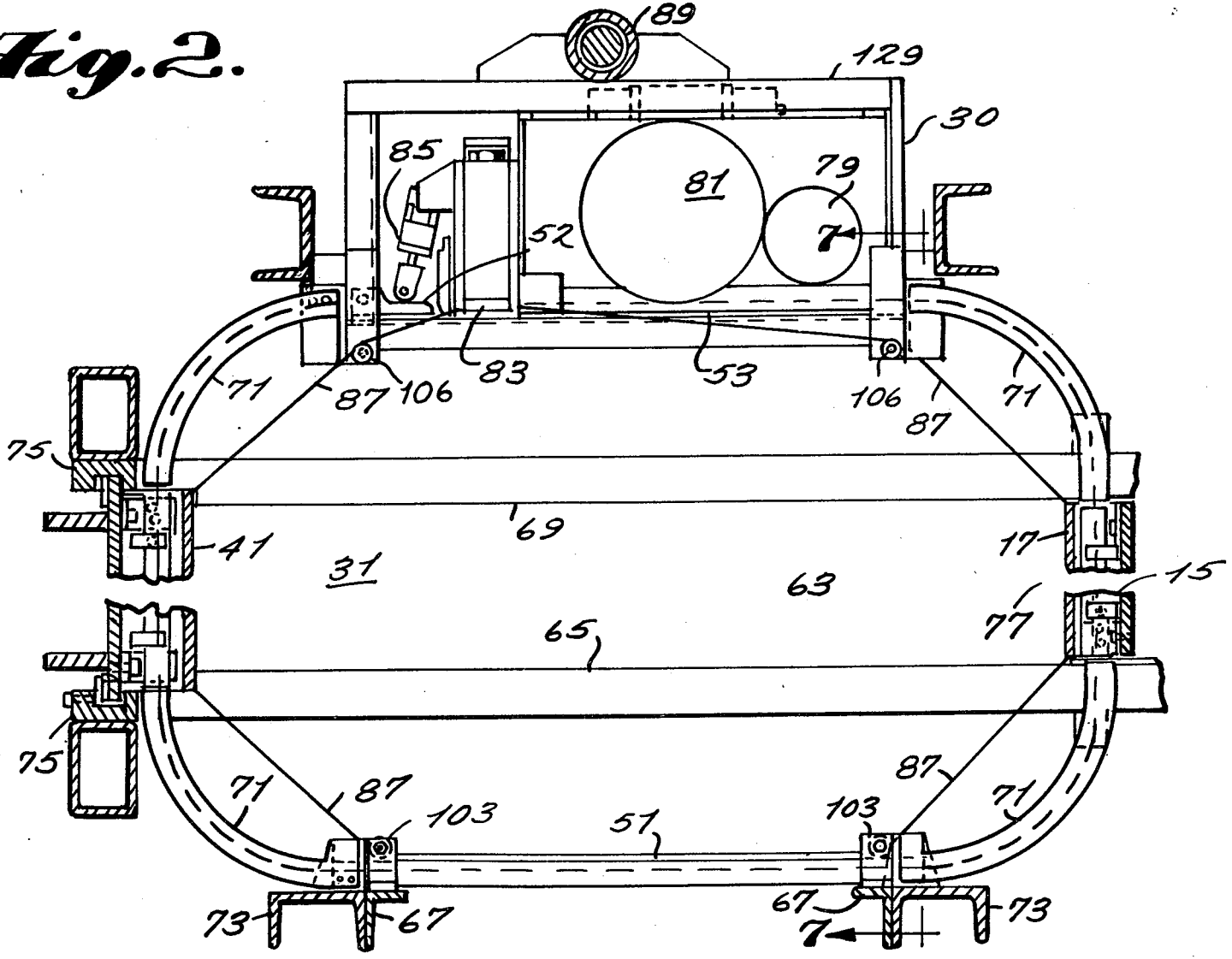
FIG. 2 is a plan view of the bale chamber, wire track and strapper mechanism of the present invention.

Refer now to FIG. 2 which is a plan view of strapper arrangement including a partial section of the baling chamber 31 of the baler mechanism. The baling chamber is closed at the bottom thereof by means of a floor 63 which may be of any suitable type such as for example, a steel plate. The chamber includes a first longitudinal side wall 65. On the opposite side of the chamber is formed a second side wall 69. At each corner of the chamber is a curved wire track 71, each of which is in the form of a quarter circle. These curved wire tracks are fixedly secured to the baling chamber and to vertical columns 73. At the output end of the chamber is a gate 41 which includes a plurality of wire guide tracks therein which mate with the curved wire tracks 71. The gate 41 is movable in a vertical direction by means of a piston and cylinder arrangement 44 with the gate being guided vertically by means of gate guides 75 positioned to each side of the gate. At the opposite end of the chamber is an opening 77 into which the ram 15 forces the material to be compressed and baled. When the appropriate amount of material has been forced into the chamber 31, as is determined by the pressure at the rear of the cylinder 21, the compression face 17 of the ram is held in the position illustrated in the figure. The ram face, as aforementioned, has a plurality of parallel wire tracks therein which mate with the curved wire tracks 71.

To the one side of the baling chamber 31 is positioned a strapping mechanism 30. The strapping mechanism includes a drive roller 79 and a feed roller 81, wherein the rollers feed wire from a spool (not shown) to the wire tracks which surround the external periphery of the baling chamber 31. Thus, for example, when a strap is being positioned around the external periphery of the baling chamber at the lowest wire track level, the rollers 79 and 81 grip and feed a suitable wire 87, such as for example, a 12 gauge wire, from the spool (not shown) through a gripping and twisting machine 83 and then through elevator wire track 52, the curved wire track 71, the wire track in gate 41, the curved wire track 71, the wire track 51, the curved wire track 71, the wire track in the ram 15, the curved wire track 71, the elevator wire track 53 and then to the gripping and twisting machine 83. When the free end of the wire is received in the gripping and twisting machine 83, a cylinder 85 is energized which grips the end of the wire. When this occurs, the drive roller 79 is reversed so that the wire in the tracks extending about the outside periphery of the chamber is tensioned. This pulls the wire 87 from the guide tracks to the position shown by the solid lines of the figure. As illustrated, the wire is forced against tension pins 103 and 106 positioned on the outside periphery of the baling chamber 31 and against the compressed material at each end of the chamber. At this time the drive roller is stopped and the gripping and twisting machine 83 twists the wire upon itself to form a completed loop. The wire is then cut and the strapping mechanism is raised by means of the elevator cylinder 55 to the next strapping level, stripping the strap off tension pins 106. The specific strapping mechanism 83 is of conventional design. One such strapping device is commercially available from the U.S. Steel Supply Co., Division of United States Steel Corporation. Thus, in the present application the disclosure of the strapping mechanism is more or less schematic in form. After all the straps of wire are in position about the bale of compressed material, the ram retracts, gate 41 raises and the tensioned straps are released from the tension pins 103, as will be more fully explained hereinbelow. The wires 87 then grip and retain the compressed material in the form of a bale. The bale is then pushed out through the outlet formed by the opened gate 41 by waste material being forced into the chamber 31 by the ram 15. After the bale has been pushed outwardly a preset distance, an ejector mechanism to be described pulls the bale completely out of the chamber and the gate 41 is then closed so that another bale can be formed.

Figure 4:
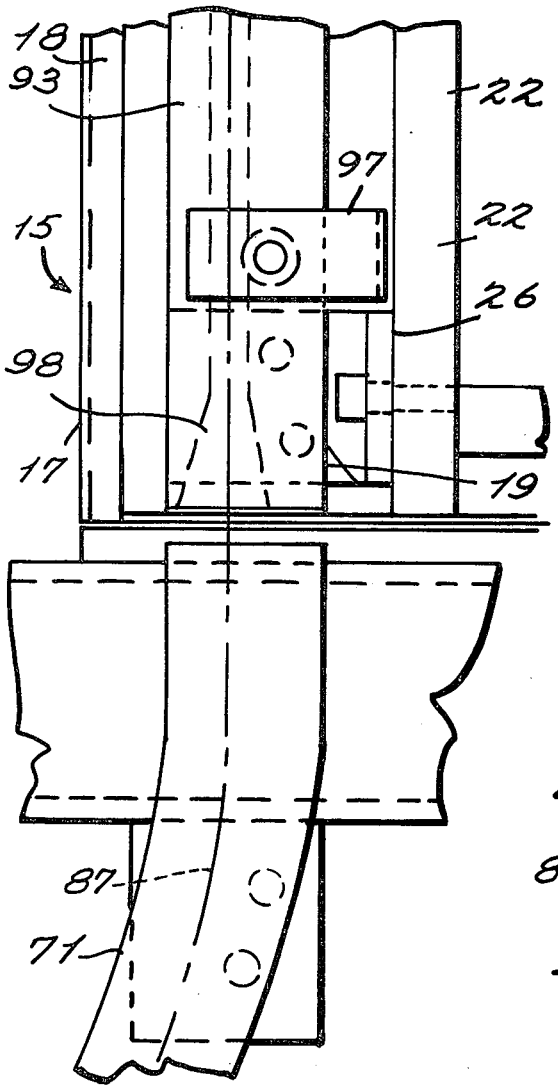
FIG. 4 is a section view of the wire track in the compression ram taken along the lines 4—4 of FIG. 3.
Figure 3:
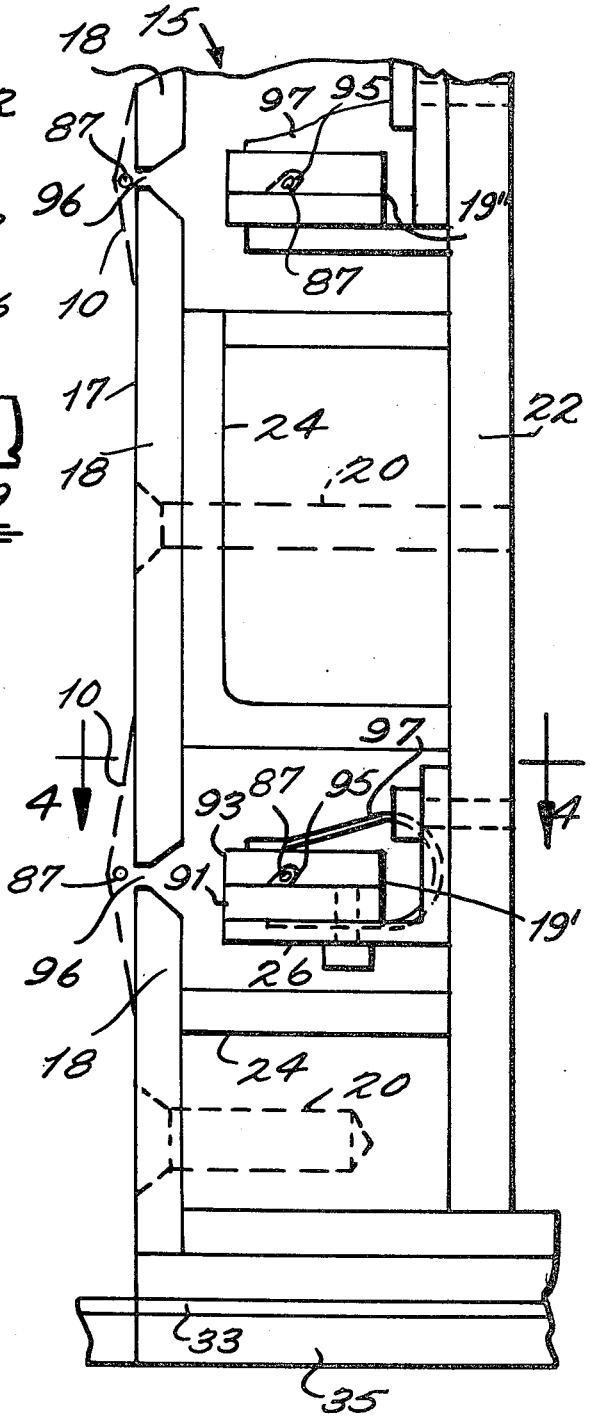
FIG. 3 is a fragmentary section view of the wire tracks in the compression ram of the present invention.

Refer now to FIGS. 3 and 4 which illustrate the arrangement of the wire tracks in the ram 15. The ram 15 includes a compression face 17 which has a plurality of plates 18 fixedly secured to the ram by a suitable means known in the art, such as for example, a weld or a nut and bolt arrangement 20. The plates 18 are spaced with respect to the rear support base 22 of the ram by means of a plurality of ribs 24. The plates 18 are not joined contiguously to one another but are spaced to permit the strapping wire 87 to pass between the plates to the position illustrated adjacent the dotted lines in FIG. 3. At the bottom of the baler is a bottom support plate 35 upon which is secured an abrasive resistant wear plate 33 which is formed of a conventional known abrasive resistant material. This plate is for the purpose of increasing the lifetime of the bottom surface of the baler and prevents wear and tear due to the sliding of the ram bottom thereon.

At spaced intervals of for example, 8 to 12 inches, are positioned wire tracks 19', 19'', etc. These tracks include a first fixed plate 91 which is fixedly secured to the bracket 26 and a second movable guide plate 93 which has a groove 95 extending therethrough. The movable guide 93 is biased into contact with the fixed plate 91 by means of a spring 97. The wire 87 is initially threaded through the groove 95 and remains therein until the tensioning mechanism of the strapper pulls the wire 87 of the groove 95 against the bias of spring 97 and through the slot 96 separating the plates 18. After the wire has been tensioned, the wire is positioned against the compressed material 10, as illustrated in FIG. 3 by the dotted lines.

Referring to FIG. 4, the curved track 71 is shown having the wire 87 passing therethrough in one of its guide tracks. The wire is guided into the wire track 19 of the ram 15 by means of a funnel-shaped entry 98. The spring 97 is shown forcing the guide plate 93 against the fixed guide support 91. The movable plate 93 is shown separated from the ram compression face plate 18 by a relatively short distance so that when the wire is tensioned, the wire is pulled from the groove 95 and from the groove in the curved track 71, past the ram compression face to the position illustrated adjacent dotted lines in FIG. 3 and solid lines in FIG. 2.

Figure 5:
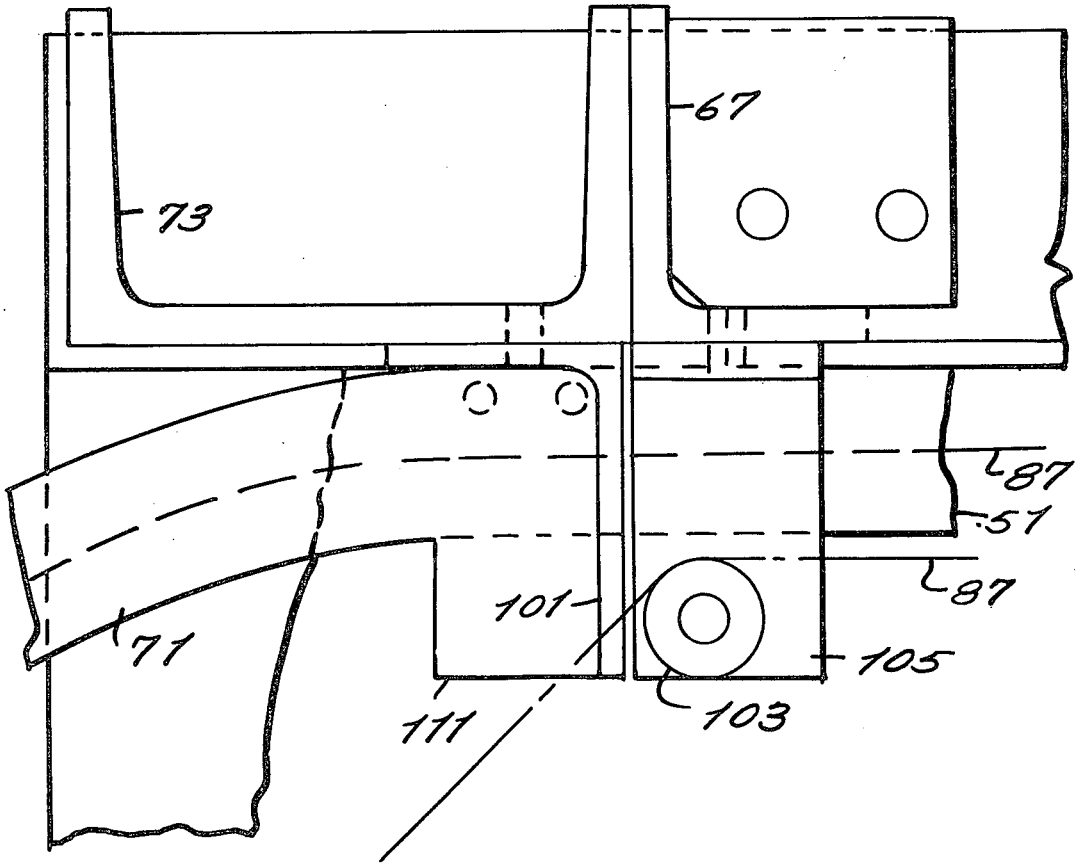
FIG. 5 is a fragmentary plan view of the tension pin arrangement utilized in the present invention.
Figure 6:
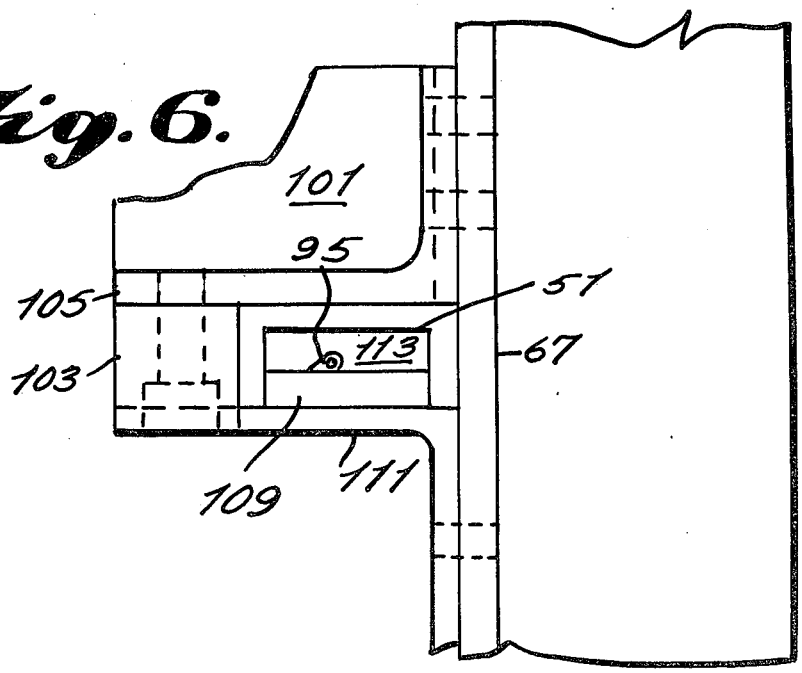
FIG. 6 is an end view of the tension pin arrangement of FIG. 5.

Refer now to FIGS. 5 and 6 which illustrate the tension pin arrangement of the closed chamber baler of the present invention. While only one specific tension pin arrangement is disclosed in FIGS. 5 and 6, it should be understood that each of the tension pins operates in a similar fashion and is of a similar design. The curved track 71 is shown fixedly secured to a vertical support column 73. Positioned above the wire track 71 is a stripping plate 101 which also is fixedly secured to the column 73. Positioned in front of the stripping plate 101 and the wire track 71 is a tension pin 103 which is rotably secured to a movable bracket 105 which in turn is fixedly secured to a movable vertical support column 67. The movable support column 67 is raised and lowered with respect to the column 73 and the stripping plate 101 by means of a cylinder 100 shown in FIG. 7. Positioned between the pin 103 and the column 67 is a wire track 51 having a fixed base plate 109 fixedly secured to a support bracket 111 which in turn is secured to the column 67. A guide plate 113 is movably positioned with respect to the plate 109 and is biased thereagainst by means of a spring (not shown).

In operation the wire 87 is threaded through a groove 95 in the movable guide plate 113. After the wire has passed completely about the baling chamber through the groove 95 in the wire tracks, the wire is tensioned, thereby forcing the wire out of the groove 95 and against the tension pin 103. In forcing the wire 87 of the groove 95, the movable guide plate 113 is raised against the bias of the spring so that the wire can slip between the plates 109 and 113. The wire then temporarily remains positioned against the tension pin 103. After the wire has been cut and twisted by the knotting mechanism 83, the wire 87 remains positioned against the tension pin 103 but is pressed against the bale of compressed waste material at the ends of the bale since there are no tension pins associated with the gate 41 and the ram 15. After each of the straps has been secured about the bale, the tension pins 103 are raised by means of the cylinder 100 which raises the column 67. The wire 87 will then be stripped from the pin by the stripping plate 101, thereby forcing the wire downwardly with respect to the pin 103 and inwardly against the bale.

Figure 7:
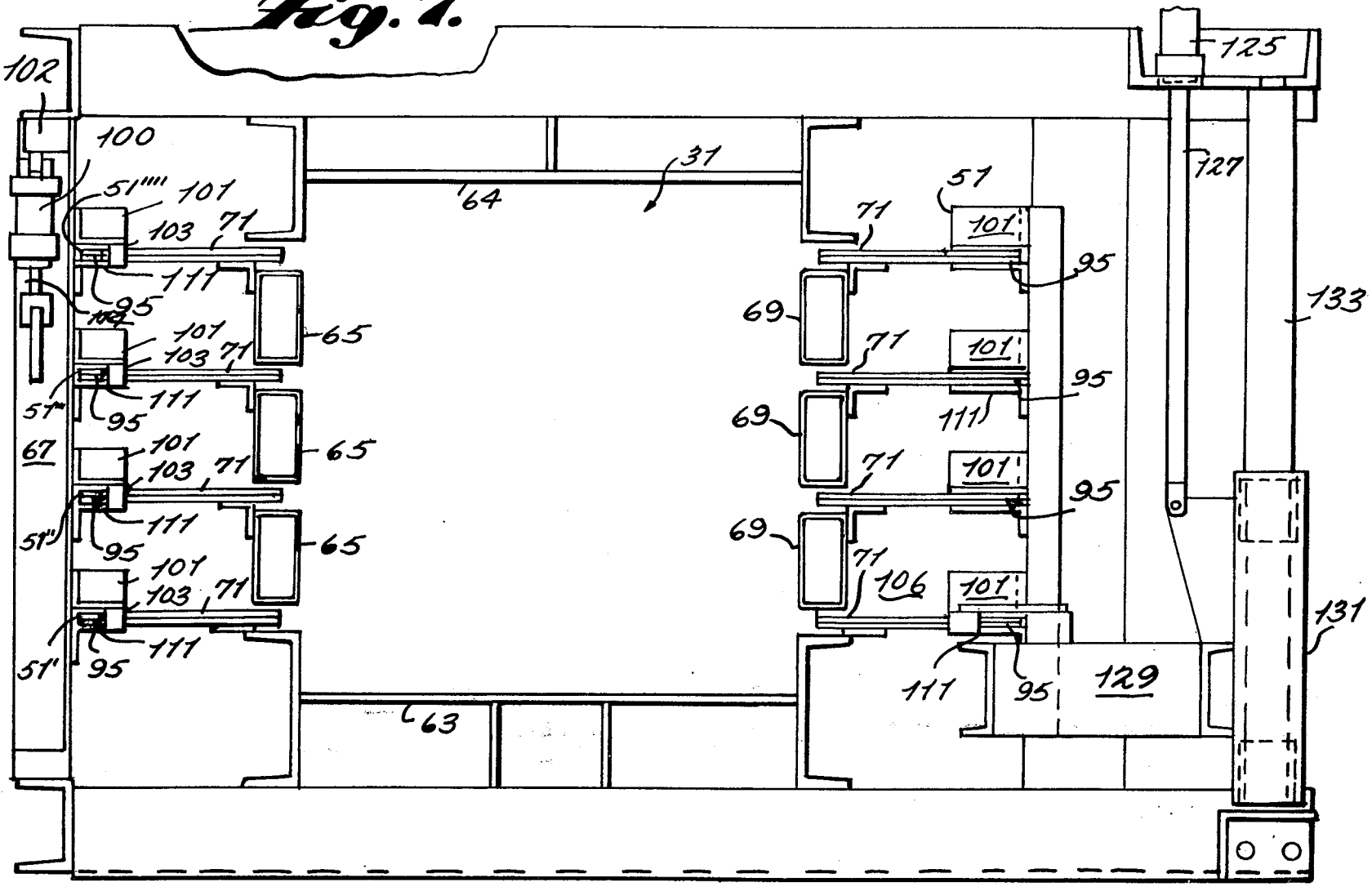
FIG. 7 is a section view taken along the lines 7—7 of FIG. 2.

Refer now to FIG. 7 which is a section view of the baling chamber taken along the lines 7—7 of FIG. 2. As illustrated, the base of the chamber includes a floor 63 upon which the bale of compressed material rests. At the top of the chamber is a roof 64 for preventing the vertical expansion of the compacted material as it is compressed within the chamber. Fixed wire tracks designated by the numerals 71 and 51 are shown having a plurality, e.g., four, of wire guide grooves 95 therein with each of the guide grooves 95 including at least two wire release mechanisms along the longitudinal length thereof including a tension pin 103 of the type illustrated in FIGS. 5 and 6. A piston and cylinder arrangement is provided wherein one end of the cylinder 100 is secured to an upper mount 102. The piston rod 104 is secured by an appropriate mechanical means to the column 67. The piston rod travels within the cylinder with a 1½ inch stroke so that when fluid under pressure is coupled to the lower part of the cylinder 100, the pins 103 are raised 1½ inches with respect to the stripping plate 101 to thereby strip the strapping wire 87 from the pins 103. Support plates 111 are provided for preventing the wire 87 once tensioned out of track from immediately sliding off the end of pin 103.

In order to provide a bearing surface on the side of the baling chamber 31, three parallel aligned tubes 65 are provided which are fixedly secured to the gate column forward and compression chamber aft. These tubes are separated from one another by a relatively small distance on the order of 1 or 2 inches to thereby provide adequate room for the wire 87 to slide therebetween and against the material being compressed and formed into a bale.

On the opposite side of the chamber 31 is a second set of wire tracks 71 and guide rails which are vertically spaced with respect to one another. The tensioning pins 106 on this side of the baling chamber 31 are fixed to the elevator to thereby strip the wire therefrom after each wire is appropriately knotted and the elevator raised. Tubes 69 form a compacting surface for the chamber 31 against which the waste material being formed into a bale is contained. The tubes 69 are separated from one another by a relatively small distance on the order of 1 or 2 inches to permit the wire 87 to contact the material being formed into a bale.

Positioned adjacent the side tubes 69 is an elevator mechanism for raising the strapping mechanism sequentially from one wire track to the next. This elevator apparatus includes a cylinder 125 having a 25½ inch stroke to which is slidably connected a piston rod 127. The piston rod at its lower end is connected to a platform 129 upon which is positioned the strapping mechanism (not shown) which includes the knotter, the gripper, the drive roll 79 and the feed roller 81. The platform 129 is stabilized laterally by means of a tube 131 which is slidably positioned about a column 133. The column 133 is fixedly secured to the bottom and top of the chamber 31 so that the tube 131 is restricted to movement in the vertical plane. Hence, platform 129 can move only in a vertical plane.

In operation, the cylinder 125 initially positions the strapping mechanism so that wire is passed through the lowest wire guides 51′. After the wire has been appropriately knotted and cut, the cylinder 125 raises the platform 129 and hence the strapping mechanism to the second wire guide level 51″, and so on until the strapping mechanism has been raised to the uppermost wire guide level. When the wire strapping operation has been completed, the cylinder 125 raises the platform 129 another inch or so to strip the strap from tension pins 106. The ram retracts, the gate raises and the outboard tension pins 103 release the straps. The bale is then ready to be ejected from the chamber.

As aforementioned, the bale is initially ejected by means of a new charge of waste paper forcing the bale outwardly. However, after the bale has been ejected a predetermined distance through the gate, such as for example, two feet, a limit switch is energized for actuating the ejector mechanism.

Figure 8:
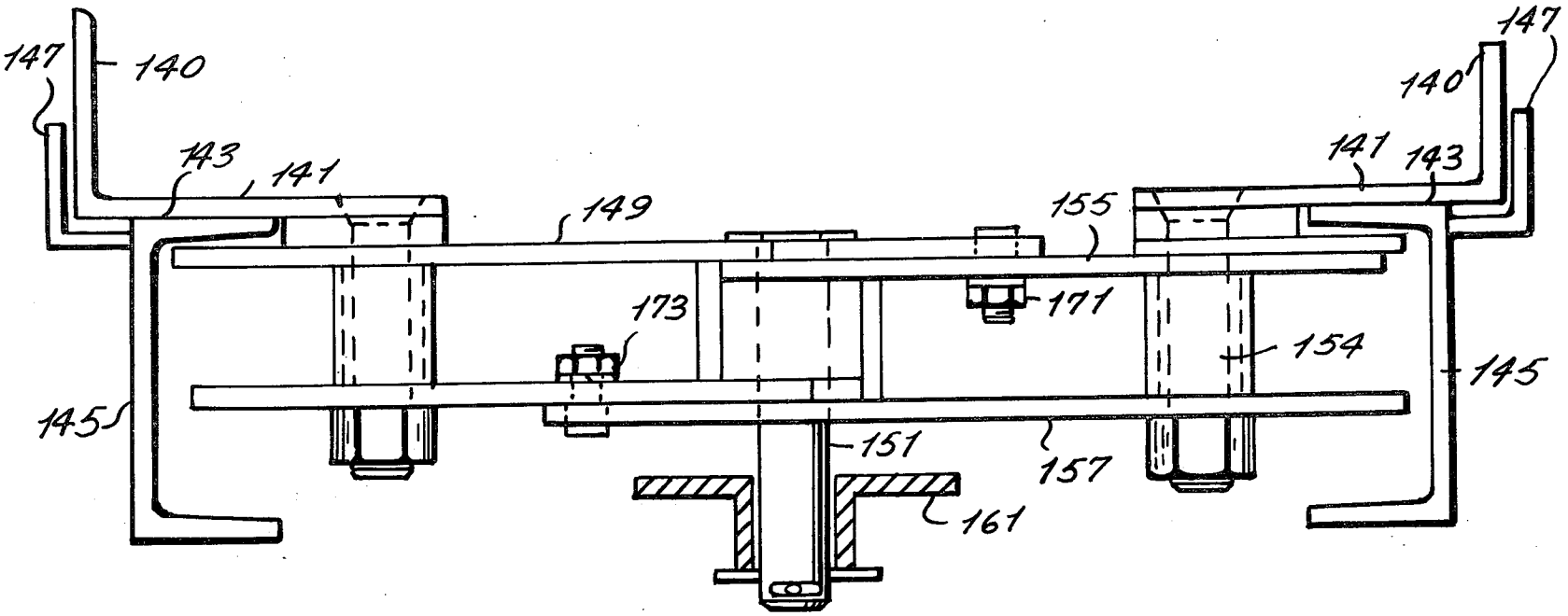
FIG. 8 is an elevation view of one embodiment of the ejector mechanism of the present invention.
Figure 9:
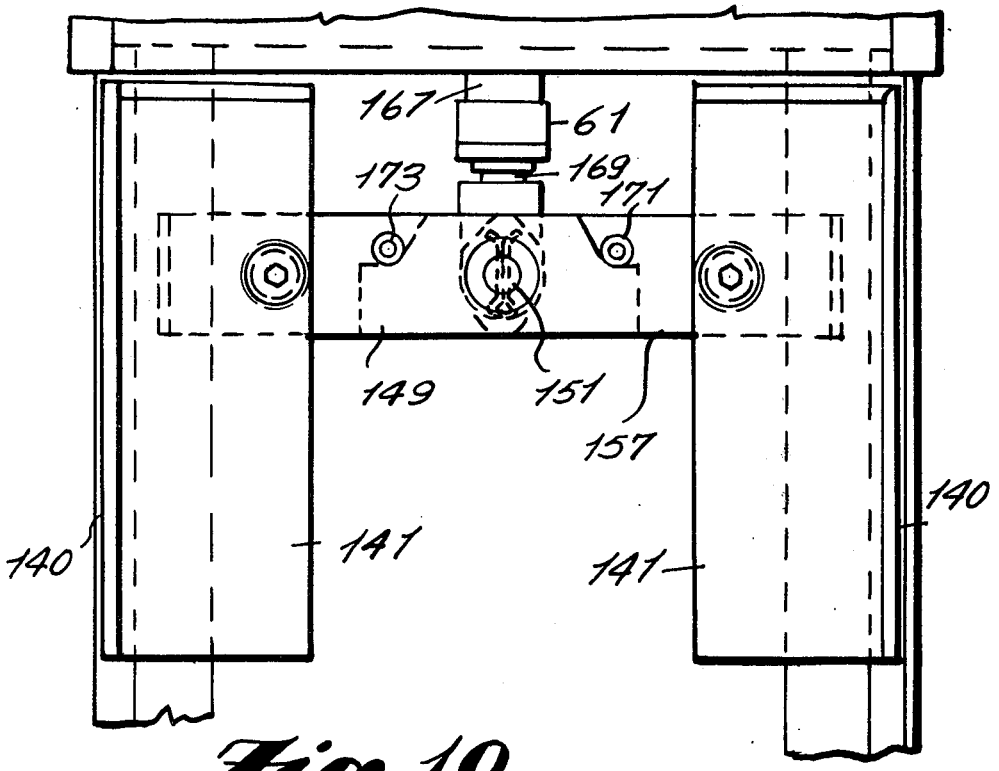
FIG. 9 is a plan view of the ejector mechanism of the present invention shown in its normal inactive position.
Figure 10:
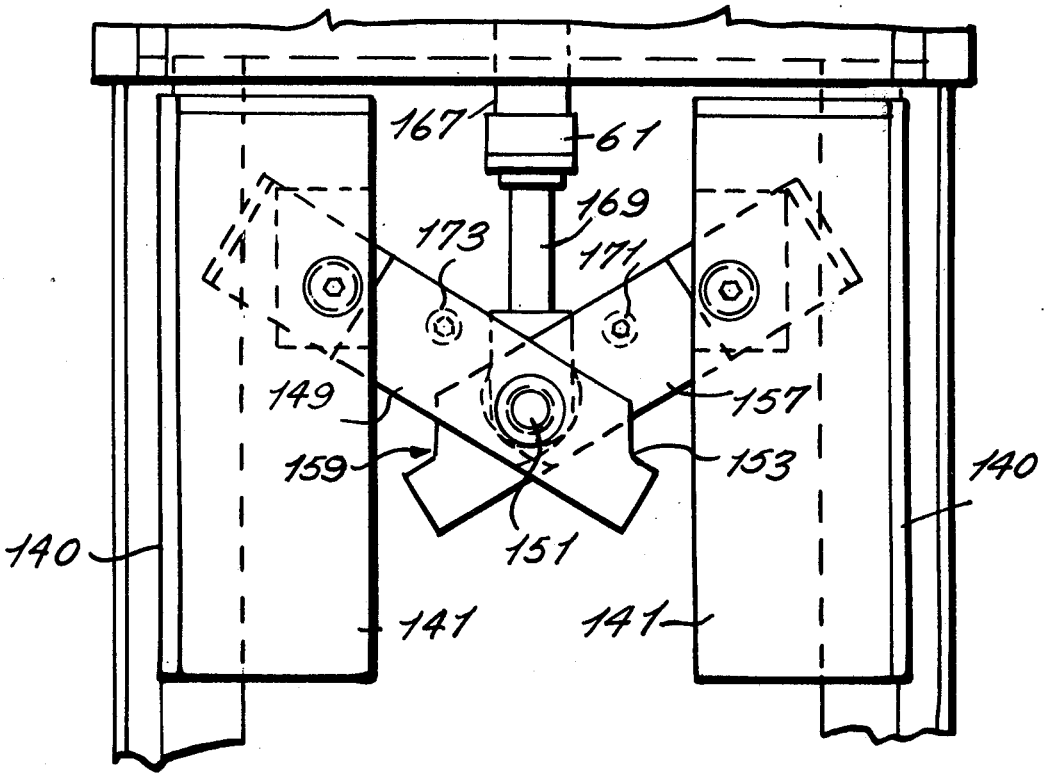
FIG. 10 is a plan view of the ejector mechanism in position for grasping and ejecting a bale from the baler of the present invention.

Refer now to FIGS. 8–10 which illustrate the operation of the ejector mechanism. FIG. 8 is a section view of the ejector mechanism looking inwardly toward the gate 41 and the baling chamber 31 from the outside thereof. The ejector mechanism includes a bale support surface 141 on each side thereof which in its simplest form includes a pair of parallel oriented angles. These angles rest upon a slide support surface 143 which forms the upper surface of ejector base 145. Fixedly secured to each of the ejector base members 145 is an ejector guide 147 which limits the lateral movement of the bale support members 141. Secured to the bale support member on the left side by means of a cap screw is a first lever arm weldment 149 which at its other end is secured to a pin 151. The weldment extends past the pin 151 for a short distance at the end of which is formed a limit pin engaging shoulder 153, as best seen in FIGS. 9 and 10. At the right side, a second lever arm weldment 155 is provided which is rotatably secured to the right side bale support surface 141 by means of a cap screw 154. This lever arm is secured to the pin 151 at its other end. Below the lever arm weldment 155 is a lower lever arm weldment 157 which is secured to the cap screw 154 at one end and has the pin 151 extending therethrough proximate the other end. However, this weldment extends past the pin 151 for a short distance and is terminated in a limit pin engaging shoulder 159. As will be seen, limit pin engaging shoulders 153 and 159 limit the movement of the lever arms 157 and 149 when being pulled in a reverse direction. In order to inhibit lateral movement of the pin 151, a pin guide 161 is provided through which the pin 151 moves in a longitudinal direction.

Refer now to FIG. 9 where the ejector mechanism is shown in its initial position. The bale supporting surfaces 141 are shown expanded in a transverse direction so the bale can slide easily onto the surfaces 141. A cylinder and piston and rod assembly 61 is provided for moving the pin 151 in the longitudinal direction. After the bale has been moved onto the supporting surfaces 141 to a predetermined distance, the ejector mechanism is energized by conducting fluid under pressure to the cylinder 61. The piston rod 169 is accordingly forced forward, as illustrated in FIG. 10, which causes the support members 141 to move inwardly toward each other so that the side walls 140 of the bale support members 141 grip the bale. After the members 141 grip the bale, they cannot move inwardly any further, and accordingly, the piston rod 169, acting on the ejector mechanism via pin 151, forces the bale to move outwardly a predetermined distance, such as for example, a distance of three or four feet. The piston rod is then reciprocated in the opposite direction, thereby opening or separating the bale support members 141 from one another so that the support members 141 and the lever arm weldments 157 and 149 are in the general position shown in FIG. 9. It is in this position that the limit pins 171 and 173 prevent the lever arm weldments 149 and 157 from further rotation so that the piston rod 169, when further retracted, pulls the bale support members 141 back to their initial position. The ejector mechanism is then set for a second cycle.

Figure 11:
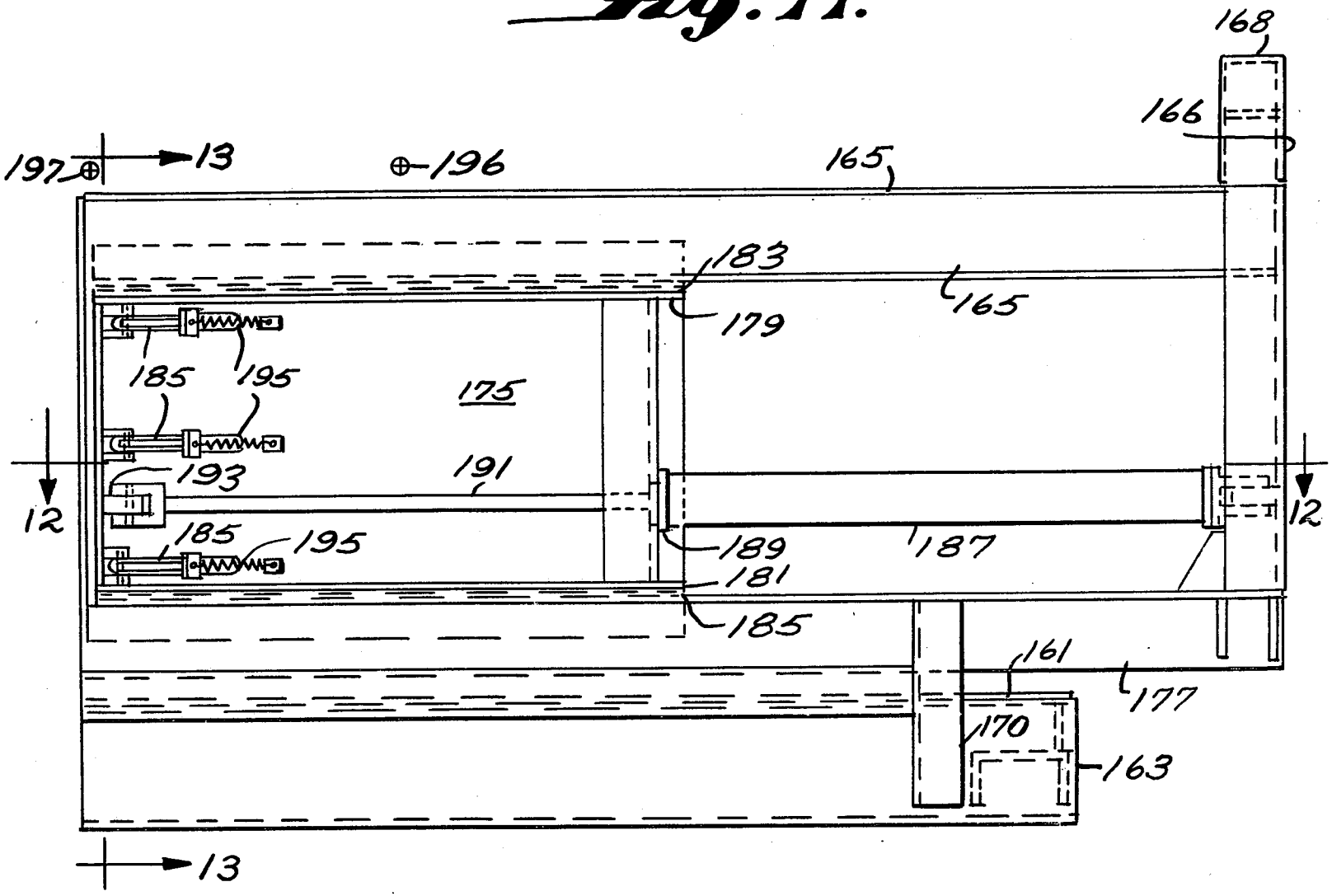
FIG. 11 is a side elevational view of an alternate embodiment of an ejector mechanism.
Figure 12:
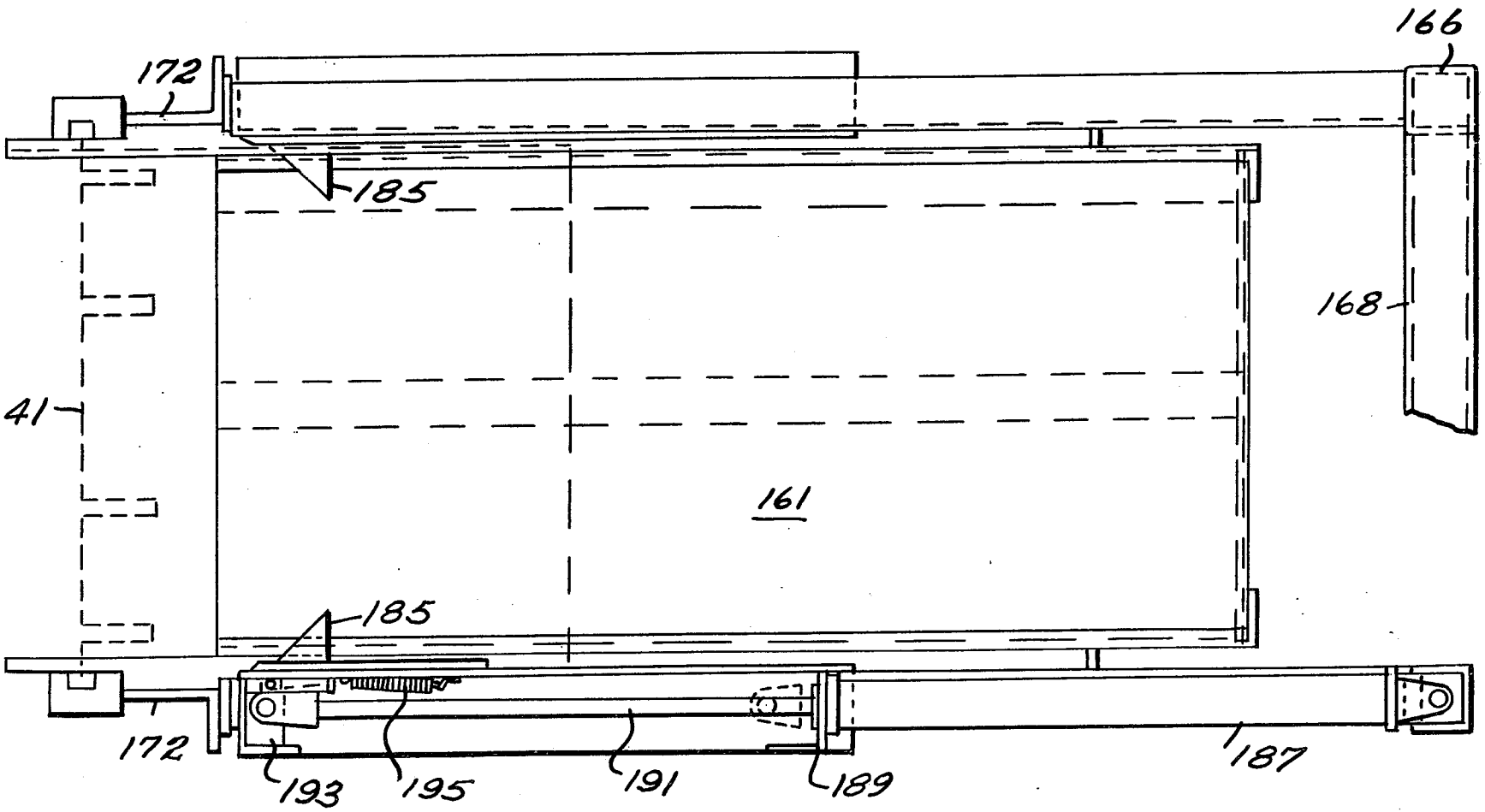
FIG. 12 is a section view of the ejector mechanism of FIG. 11, taken along the lines 12—12 thereof.
Figure 13:
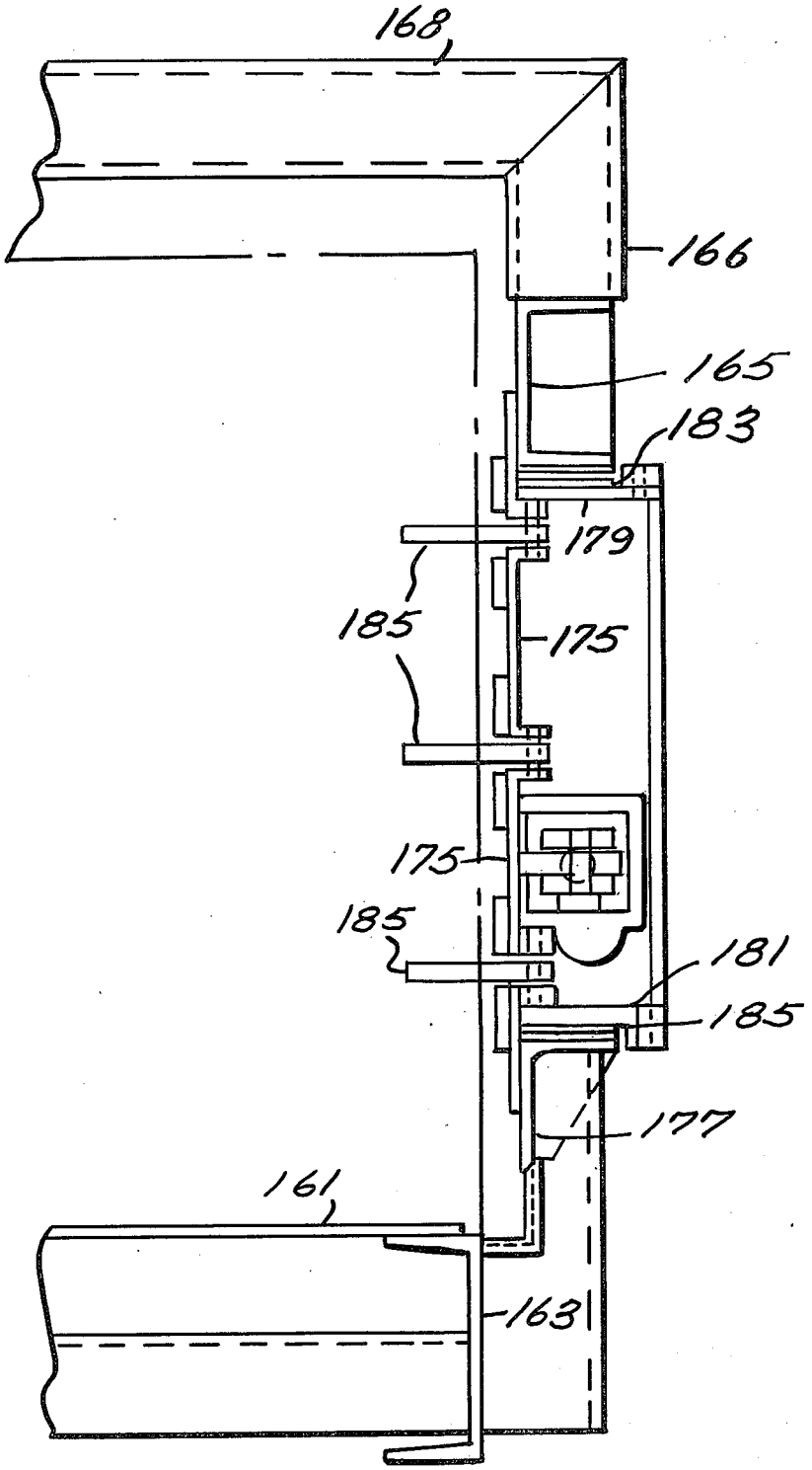
FIG. 13 is a partial sectional view of the bale ejector mechanism of FIG. 11 taken along the lines 13—13 thereof.

Refer now to FIGS. 11–13 which illustrate an alternate embodiment of the automatic ejector system of the present invention. As illustrated in FIG. 11, a bed plate 161 formed of a smooth metallic plate is supported by a bed plate support 163. Positioned about the bed plate 161 is an ejector frame which includes a pair of ejector side frames 165 which extend substantially over the longitudinal length of the ejector mechanism on each side thereof and which are secured at the output end of the ejector to a pair of vertical ejector support tubes 166. The vertical tubes 166 are maintained in a spaced relationship with respect to one another by means of a tube header 168 which extends across at the top of the tubes 166 and by the frame support 170 at the bottom of the ejector mechanism. At the input end of the ejector the side frames 165 are secured to vertical support member 172 illustrated in FIG. 12.

As best illustrated in FIG. 13, an ejector platen 175 is reciprocally positioned inside of the ejector frame at each side thereof with the top portion of the platen 175 being slidably positioned against the inside surface of the side frame 165 and the bottom portion being positioned slidably against the side frame member 177. A wear bar support 179 is fixedly secured to the upper outside portion of the ejector platen 175 and a second wear bar support 181 is fixedly secured to the outside of the ejector platen approximate the bottom thereof. Positioned on the upper and lower surfaces of the wear bar supports 179 and 181, respectively, are wear bars 183 and 185, respectively. The wear bars 183 and 185 provide for a relatively low friction yet durable sliding surface over which the platen 175 and the hydraulic mechanism for driving the ejector platen can move within the frame of the ejector mechanism.

Also illustrated in FIG. 13 are a plurality of bale dogs 185 which are rotatably secured to the ejector platens 175 on each side of the ejector mechanism and which are spring biased inwardly so that the dogs extend inwardly toward the center of the ejector mechanism. As illustrated in FIGS. 11 and 12, a piston and cylinder arrangement is provided with one end of the cylinder 187 being fixedly secured to a vertical tube 166. The piston rod 191 which is reciprocated by means of the piston and cylinder arrangement 187 is secured to the ejector platen 175 by means of a mounting support 193. A second piston and cylinder arrangement (not shown) is located on the opposite side of the ejector mechanism to reciprocate the ejector platen 175 positioned on the opposite side of the ejector chamber.

The input end of the ejector mechanism is fixedly secured to the output end of the baling chamber with the gate mechanism 41 being shown in phantom.

In operation when a bale is being formed in the baling chamber 31, the gate 41 is closed and, accordingly, no material is positioned within the ejector mechanism. Accordingly, under the bias of springs 195 the bale dogs 185 are biased inwardly toward the center of the chamber as illustrated in FIG. 12. At the same time, the piston rods 191 are fully extended so that the platens 175 on each side of the ejector mechanism are positioned at the extreme left end of the ejector mechanism as illustrated in FIGS. 11 and 12. After a bale has been formed, gate 41 is opened and the bale is pushed into the ejector mechanism as new material is forced into the baling chamber 31. When the bale has been pushed past the ejector limit switch 196 illustrated schematically in FIG. 11, the cylinders 187 are energized into a reciprocating mode of operation by hydraulic means of conventional design and which are not illustrated herein for clarity and conciseness in the description of the invention. Accordingly, the bale dogs 185 which were initially pushed outward against the bias of the springs 195 tend to move inwardly to grip the bale as the piston rods 191 move toward the output end of the ejector. Accordingly, the bale is pulled along with the movement of the ejector platens 175 and the bale dogs 185 for the entire stroke of the piston rods 191. When the piston rods 191 reach the end of their stroke and assuming that a portion of the bale still remains in the baling chamber 31, the piston rods 191 move back to their original position with the bale dogs 185 being pushed inwardly against the bias of springs 195. The piston rods 191 are again pulled to the right thereby causing the bale dogs to grip the bale thereby pulling the bale further through the ejector mechanism. When the bale has been pulled past limit switch 197 illustrated in FIG. 11, the gate mechanism 41 is energized to close to thereby permit the formation of a new bale within the baling chamber 31. Subsequently, as the tail end of the bale being ejected passes the ejector limit switch 196 further reciprocatory movement of the piston rods 191 cease and the piston rod is returned to its normal position illustrated in FIGS. 11 and 12.

In the preferred embodiment for purposes of ejecting a bale having a length of approximately 66 inches and a width of around 32 inches, the ejector side frame is approximately 75 inches and the cylinder 187 has a 30 inch stroke capable of generating a force of 14,600 lbs. pull at 2400 psi. Thus, it can be seen that the ejector mechanism of this alternate embodiment has a compact structure which is capable of efficiently and rapidly ejecting bales formed by the closed chamber baler of the present invention.

The hydraulic system for operating the various hydraulic piston and cylinder arrangements is of conventional design and the timing of the operation of various hydraulically operated cylinders is as set forth hereinabove in connection with the description of various features of the present invention.

While applicant's invention has been disclosed in connection with a preferred embodiment thereof, it should be understood that there may be other obvious variations of applicant's invention which fall within the spirit and scope of the invention as defined by the appended claims.

What is claimed is:

1. A closed chamber baler comprising in combination:

a hopper into which compressible material is fed, a bale chamber is which said material is compressed and formed into bales, means for forcing said material from said hopper into said bale chamber, means for guiding strapping wires about the external periphery of said bale chamber after a predetermined quantity of material has been forced into said chamber, said wires being positioned about the outside of said chamber at a plurality of vertically spaced intervals, means for tensioning said strapping wires about said compressed material, means for releasing said strapping wires to engage said compressed material to thereby form a bale, and means for ejecting said bale from said bale chamber, said ejecting means including means for moving said bale outside of said chamber through said open gate, reciprocating means for gripping said bale and pulling said bale outwardly away from said baling chamber, said gripping means including a pair of ejector platens positioned to each side of said ejector for defining the sides thereof, said ejector platens each having a plurality of bale dogs rotatably attached thereto, said bale dogs being normally biased inwardly toward the center of said ejector for gripping said bale, means for closing said gate when said bale has been completely removed from said baling chamber, and means for deactivating said reciprocating means when said bale has been moved a predetermined distance from said gate.

2. The closed chamber baler of claim 1 wherein said ejector further comprises means for reciprocating said ejector platens with respect to said gate, said dogs gripping said bale when said ejector platens are moved away from said gate.

3. The closed chamber baler of claim 2 wherein said means for reciprocating said ejector platens is at least one cylinder having a piston rod reciprocating with respect thereto said piston rod being fixedly secured to at least one of said ejector platens.

4. A closed chamber baler for forming bales of compressed material into a generally rectangular form comprising in combination:

a hopper into which compressible material is fed, a bale chamber in which said material is compressed and formed into said bales, said bale chamber including side walls and a gate, means for forcing said material from said hopper into said bale chamber, said means including a ram having a face which forms one end of said compression chamber, means for guiding strapping wires about the external periphery of said bale chamber after a predetermined quantity of material has been forced into said chamber, said wires being positioned about the outside of said chamber at a plurality of vertically spaced intervals, means for tensioning said strapping wires about said compressed material, means for releasing said strapping wires to engage said compressed material proximate said ram and said gate and for retaining said strapping wires from engaging said compressed material proximate the side walls of said compression chamber to thereby free said gate and said ram for movement with respect to said compressed material, and means for ejecting said bale from said bale chamber, said ejecting means including means for moving said bale outside of said chamber through said open gate, reciprocating means for gripping said bale and pulling said bale outwardly away from said baling chamber, said gripping means including a pair of ejector platens positioned to each side of said ejector for defining the sides thereof, said ejector platens each having a plurality of bale dogs rotatably attached thereto, said bale dogs being normally biased inwardly toward the center of said ejector for gripping said bale, means for closing said gate when said bale has been completely removed from said baling chamber, and means for deactivating said reciprocating means when said bale has been moved a predetermined distance from said gate.

5. A closed chamber baler for forming bales of compressed material into a generally rectangular form comprising in combination:

a hopper into which compressible material is fed, a bale chamber in which said material is compressed and formed into said bales, said bale chamber including side walls and a gate, means for forcing said material from said hopper into said bale chamber, said means including a ram having a face which forms one end of said compression chamber, means for guiding strapping wires about the external periphery of said bale chamber after a predetermined quantity of material has been forced into said chamber, said wires being positioned about the outside of said chamber at a plurality of vertically spaced intervals, means for tensioning said strapping wires about said compressed material, means for releasing said strapping wires to engage said compressed material proximate said ram and said gate and for retaining said strapping wires from engaging said compressed material proximate the side walls of said compression chamber to thereby free said gate and said ram for movement with respect to said compressed material, and means for ejecting said bale from said bale chamber, said ejecting means comprising a smooth metallic bed plate for permitting relatively easy movement of said bale thereover and a pair of ejector platens positioned to each side of said ejector for defining the sides of said ejector, said ejector platens each having a plurality of bale dogs rotatably attached thereto, said bale dogs being normally biased inwardly toward the center of said ejector.

* * * * *